US009222673B2

(12) United States Patent
Boardman et al.

(10) Patent No.: US 9,222,673 B2
(45) Date of Patent: Dec. 29, 2015

(54) FUEL NOZZLE AND METHOD OF ASSEMBLING THE SAME

(71) Applicant: General Electric Company, Schenectady, NY (US)

(72) Inventors: Gregory Allen Boardman, Greer, SC (US); Mark Allan Hadley, Greer, SC (US); Johnie Franklin McConnaughhay, Greenville, SC (US)

(73) Assignee: General Electric Company, Schenectady, NY (US)

( * ) Notice: Subject to any disclaimer, the term of this patent is extended or adjusted under 35 U.S.C. 154(b) by 432 days.

(21) Appl. No.: 13/647,636

(22) Filed: Oct. 9, 2012

(65) Prior Publication Data

US 2014/0097276 A1 Apr. 10, 2014

(51) Int. Cl.

| | |
|---|---|
| ***F23R 3/14*** | (2006.01) |
| ***F23R 3/28*** | (2006.01) |
| ***F23D 11/10*** | (2006.01) |
| ***F23R 3/36*** | (2006.01) |
| ***F23D 17/00*** | (2006.01) |

(52) U.S. Cl.

CPC ..... *F23R 3/14* (2013.01); *F23D 11/103* (2013.01); *F23D 11/105* (2013.01); *F23D 17/002* (2013.01); *F23R 3/286* (2013.01); *F23R 3/36* (2013.01); *Y10T 29/49826* (2015.01)

(58) Field of Classification Search

CPC ... F23D 11/102; F23D 11/103; F23D 11/105; F23R 3/14; F23R 3/286; F02M 61/162

See application file for complete search history.

(56) References Cited

U.S. PATENT DOCUMENTS

| | | | | |
|---|---|---|---|---|
| 4,984,965 | A | 1/1991 | McKean | |
| 5,319,935 | A * | 6/1994 | Toon et al. | 60/733 |
| 6,094,916 | A * | 8/2000 | Puri et al. | 60/737 |
| 6,151,899 | A * | 11/2000 | Park | 60/748 |
| 6,253,555 | B1 * | 7/2001 | Willis | 60/737 |
| 2009/0111063 | A1 * | 4/2009 | Boardman et al. | 431/8 |
| 2009/0205339 | A1 * | 8/2009 | Huang et al. | 60/737 |
| 2010/0229557 | A1 | 9/2010 | Matsumoto et al. | |
| 2012/0111012 | A1 * | 5/2012 | Axelsson et al. | 60/737 |

* cited by examiner

*Primary Examiner* — Ryan Reis

(74) *Attorney, Agent, or Firm* — Armstrong Teasdale LLP

(57) ABSTRACT

A fuel nozzle is provided. The fuel nozzle includes a nozzle body, a plurality of swirler vanes, and at least one outlet. The nozzle body includes a back plate, a front plate, and a mixing zone defined therebetween. The back plate includes at least one inlet defined therein and the front plate includes at least one discharge defined therein. The plurality of swirler vanes are positioned between the back plate and the front plate and spaced circumferentially about the mixing zone. Each of the plurality of swirler vanes direct air obliquely into the mixing zone. The at least one outlet is defined within at least one of the nozzle body and the plurality of swirler vanes, the at least one outlet configured to inject fuel into said mixing zone.

18 Claims, 9 Drawing Sheets

FUEL NOZZLE AND METHOD OF ASSEMBLING THE SAME

BACKGROUND OF THE INVENTION

The field of the present disclosure relates generally to turbine engines and, more specifically, to a fuel nozzle for use with a turbine engine.

Rotary machines, such as gas turbines, are often used to generate power for electric generators. Gas turbines, for example, have a gas path which typically includes, in serial-flow relationship, an air intake, a compressor, a combustor, a turbine, and a gas outlet. Compressor and turbine sections include at least one row of circumferentially-spaced rotating buckets or blades coupled within a housing. At least some known turbine engines are used in cogeneration facilities and power plants. Such engines may have high specific work and power per unit mass flow requirements. To increase operating efficiency, at least some known gas turbine engines may operate at increased combustion temperatures. Engine efficiency generally increases as combustion gas temperatures increase.

However, operating known turbine engines at higher temperatures may also increase the generation of polluting emissions, such as oxides of nitrogen ($NO_X$). Such emissions are generally undesirable and may be harmful to the environment. To facilitate reducing NOx emissions, at least some known gas turbine plants use selective catalytic reduction (SCR) systems. Known SCR systems convert NOx, with the aid of a catalyst, into elemental nitrogen and water. However, SCR systems increase the overall costs associated with turbine operation.

At least some known fuel injection assemblies attempt to reduce NOx emissions by using pre-mixing technology. In such assemblies, a portion of fuel and air is mixed upstream from the combustor to produce a lean mixture. Pre-mixing the fuel and air facilitates controlling the temperature of the combustion gases such that the temperature does not rise above a threshold where NOx emissions are formed. Some known fuel injection assemblies include supplemental burners that extend through a circumferential wall of a combustor cylinder, wherein the assembly includes passages that deflect air radially inward with respect to the combustor cylinder. However, known supplemental burners may not adequately mix the fuel-air mixture and generally do not have liquid fuel injection capabilities.

BRIEF DESCRIPTION OF THE INVENTION

In one aspect, a method of assembling a fuel nozzle is provided. The method includes providing a nozzle body that includes a back plate, a front plate, and a mixing zone defined therebetween. The back plate includes at least one inlet defined therein and the front plate includes at least one discharge defined therein. The method also includes positioning a plurality of swirler vanes between the front plate and the back plate and circumferentially about the mixing zone such that the plurality of swirler vanes direct air obliquely into the mixing zone. At least one outlet is defined within at least one of the nozzle body and the plurality of swirler vanes, wherein the at least one outlet is configured to inject fuel into the mixing zone.

In another aspect, a fuel nozzle is provided. The fuel nozzle includes a nozzle body, a plurality of swirler vanes, and at least one outlet. The nozzle body includes a back plate, a front plate, and a mixing zone defined therebetween. The back plate includes at least one inlet defined therein and the front plate includes at least one discharge defined therein. The plurality of swirler vanes are positioned between the back plate and the front plate and spaced circumferentially about the mixing zone. Each of the plurality of swirler vanes direct air obliquely into the mixing zone. The at least one outlet is defined within at least one of the nozzle body and the plurality of swirler vanes, the at least one outlet configured to inject fuel into said mixing zone.

In yet another aspect, a gas turbine assembly is provided. The gas turbine assembly includes a combustor and a fuel nozzle coupled to the combustor. The fuel nozzle includes a nozzle body, a plurality of swirler vanes, and at least one outlet. The nozzle body includes a back plate, a front plate, and a mixing zone defined therebetween. The back plate includes at least one inlet defined therein and the front plate includes at least one discharge defined therein. The plurality of swirler vanes are positioned between the back plate and the front plate and spaced circumferentially about the mixing zone. Each of the plurality of swirler vanes direct air obliquely into the mixing zone. The at least one outlet is defined within at least one of the nozzle body and the plurality of swirler vanes, the at least one outlet configured to inject fuel into said mixing zone.

DETAILED DESCRIPTION OF THE INVENTION

Embodiments of the present disclosure are directed to turbine assemblies and more specifically, to a fuel nozzle for reducing the production of NOx emissions of a gas turbine engine. Even more specifically, embodiments of the present disclosure are directed to a radial inflow, dual-fuel, late-lean-injection pre-mixing fuel nozzle that enables mixing of fuel and air prior to use in a combustor assembly. For example, the fuel nozzle described herein includes a plurality of swirler vanes that produce a substantially uniform fuel-air mixture for use in a combustor assembly.

In the exemplary embodiments, the swirler vanes are arranged about a mixing zone of the fuel nozzle and direct air obliquely into the mixing zone. More specifically, air flow passages are formed between adjacent swirler vanes and each swirler vane is angled away from a radial centerline of the fuel nozzle such that air channeled through the air flow passages is swirled about a centerline axis of the fuel nozzle. Fuel is injected into the mixing zone as air is swirled to create a substantially uniform fuel-air mixture. Furthermore, the fuel nozzle may use both liquid fuel and/or gas fuel for combustion purposes. Accordingly, the fuel nozzle described herein is a fuel-flexible pre-mixer that facilitates reducing NOx emissions that may form from combustion.

Figure 1:
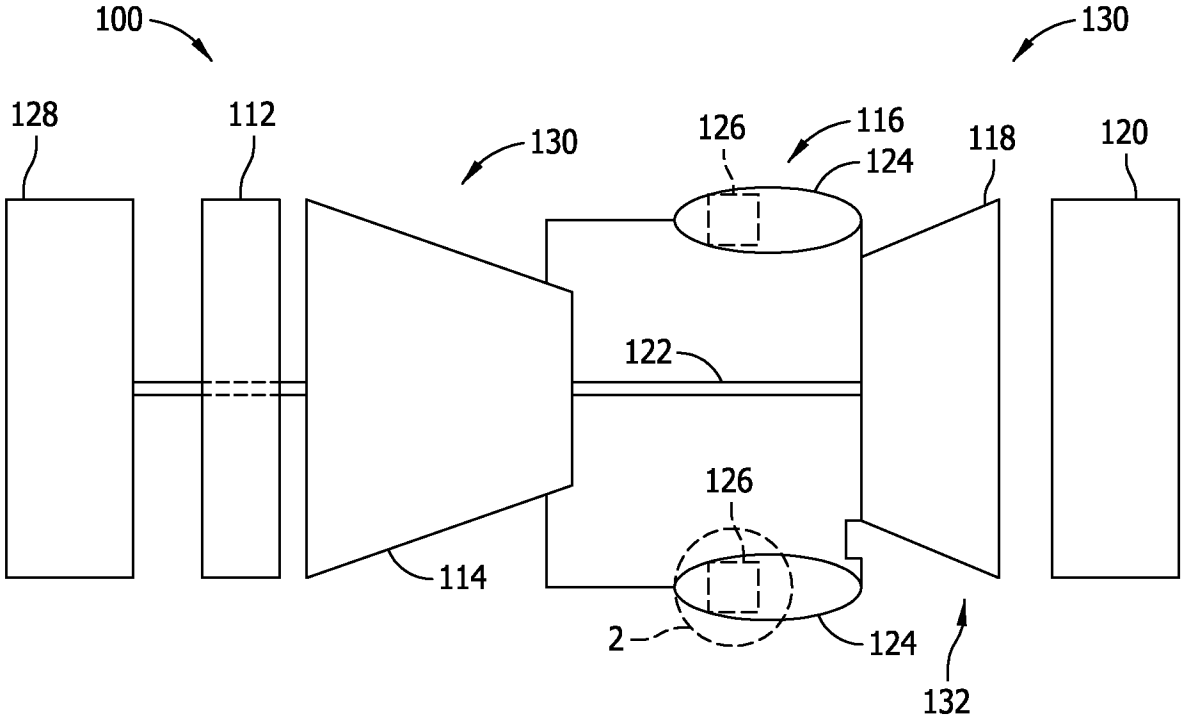
FIG. 1 is a schematic view of an exemplary turbine engine.

FIG. 1 is a schematic view of an exemplary turbine engine 100. More specifically, in the exemplary embodiment turbine engine 100 is a gas turbine engine that includes an intake section 112, a compressor section 114 downstream from intake section 112, a combustor section 116 downstream from compressor section 114, a turbine section 118 downstream from combustor section 116, and an exhaust section 120. Turbine section 118 is coupled to compressor section 114 via a rotor shaft 122. In the exemplary embodiment, combustor section 116 includes a plurality of combustors 124. Combustor section 116 is coupled to compressor section 114 such that each combustor 124 is in flow communication with compressor section 114. A fuel nozzle assembly 126 is coupled within each combustor 124. Turbine section 118 is coupled to compressor section 114 and to a load 128 such as, but not limited to, an electrical generator and/or a mechanical drive application through rotor shaft 122. In the exemplary embodiment, each of compressor section 114 and turbine section 118 includes at least one rotor disk assembly 130 that is coupled to rotor shaft 122 to form a rotor assembly 132.

During operation, intake section 112 channels air towards compressor section 114 wherein the air is compressed to a higher pressure and temperature prior to being discharged towards combustor section 116. The compressed air is mixed with fuel and other fluids provided by each fuel nozzle assembly 126 and then ignited to generate combustion gases that are channeled towards turbine section 118. More specifically, each fuel nozzle assembly 126 injects fuel, such as natural gas and/or fuel oil, air, diluents, and/or inert gases, such as nitrogen gas ($N_2$), into respective combustors 124, and into the air flow. The fuel mixture is ignited to generate high temperature combustion gases that are channeled towards turbine section 118. Turbine section 118 converts the energy from the gas stream to mechanical rotational energy, as the combustion gases impart rotational energy to turbine section 118 and to rotor assembly 132.

Figure 2:
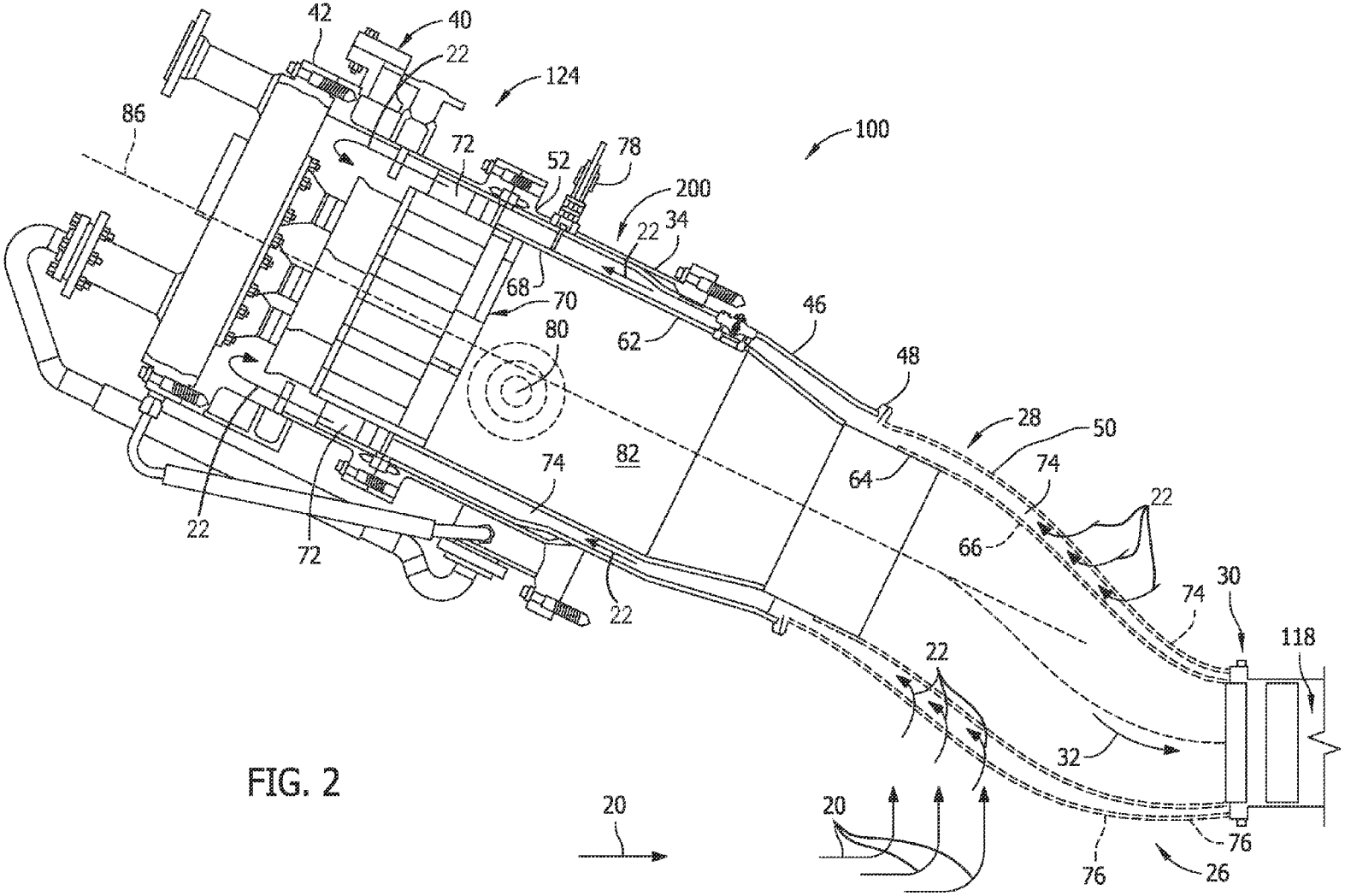
FIG. 2 is a sectional view of an exemplary combustor assembly that may be used with the turbine engine shown in FIG. 1.

FIG. 2 is a sectional view of combustor 124 that may be used with turbine engine 100. In the exemplary embodiment, combustor 124 is, but is not limited to being, a can-annular combustor. Moreover, in the exemplary embodiment, turbine engine 100 includes a double-walled transition duct 26. More specifically, in the exemplary embodiment, transition duct 26 extends between an outlet end 28 of each combustor 124 and an inlet end 30 of turbine section 118 to channel combustion gases 32 into turbine section 118. Further, in the exemplary embodiment, each combustor 124 includes a substantially cylindrical combustor casing 34. In the exemplary embodiment, a forward end 40 of combustor casing 34 is coupled to an end cover assembly 42. End cover assembly 42 includes, for example, supply tubes, manifolds, valves for channeling gaseous fuel, liquid fuel, air and/or water to the combustor, and/or any other components that enable turbine engine 100 to function as described herein.

In the exemplary embodiment, a substantially cylindrical flow sleeve 46 is coupled within combustor casing 34 such that flow sleeve 46 is substantially concentrically aligned with casing 34. Flow sleeve 46 is coupled at an aft end 48 of transition duct 26 to an outer wall 50 of transition duct 26 and coupled at a forward end 52 of combustor casing 34. Furthermore, in the exemplary embodiment, flow sleeve 46 includes a combustion liner 62 coupled therein. Combustion liner 62 is aligned substantially concentrically within flow sleeve 46 such that an aft end 64 is coupled to an inner wall 66 of transition duct 26, and such that a forward end 68 is coupled to a combustion liner cap assembly 70. Combustion liner cap assembly 70 is secured within combustor casing 34 by a plurality of struts 72 and an associated mounting assembly (not shown). In the exemplary embodiment, a first air plenum 74 is defined between liner 62 and flow sleeve 46, and between transition duct inner and outer walls 66 and 50. Furthermore, in one embodiment, combustor 124 includes a sheet 84 (not shown in FIG. 2) that is aligned substantially concentrically about flow sleeve 46 such that a second air plenum 94 (not shown in FIG. 2) is defined between sheet 84 and flow sleeve 46. Transition duct outer wall 50 includes a plurality of apertures 76 defined therein that enable compressed air 20 from compressor section 114 (shown in FIG. 1) to enter first air plenum 74. In the exemplary embodiment, air 22 flows in a direction opposite to a direction of core flow (not shown) from compressor section 114 towards end cover assembly 42. Further, in the exemplary embodiment, combustor 124 also includes a plurality of spark plugs 78 and a plurality of cross-fire tubes 80. Spark plugs 78 and cross-fire tubes 80 extend through ports (not shown) in liner 62 that are defined downstream from combustion liner cap assembly 70 within a combustion zone 82. Spark plugs 78 and cross-fire tubes 80 ignite fuel and air within each combustor 124 to create combustion gases 32.

Figure 3:
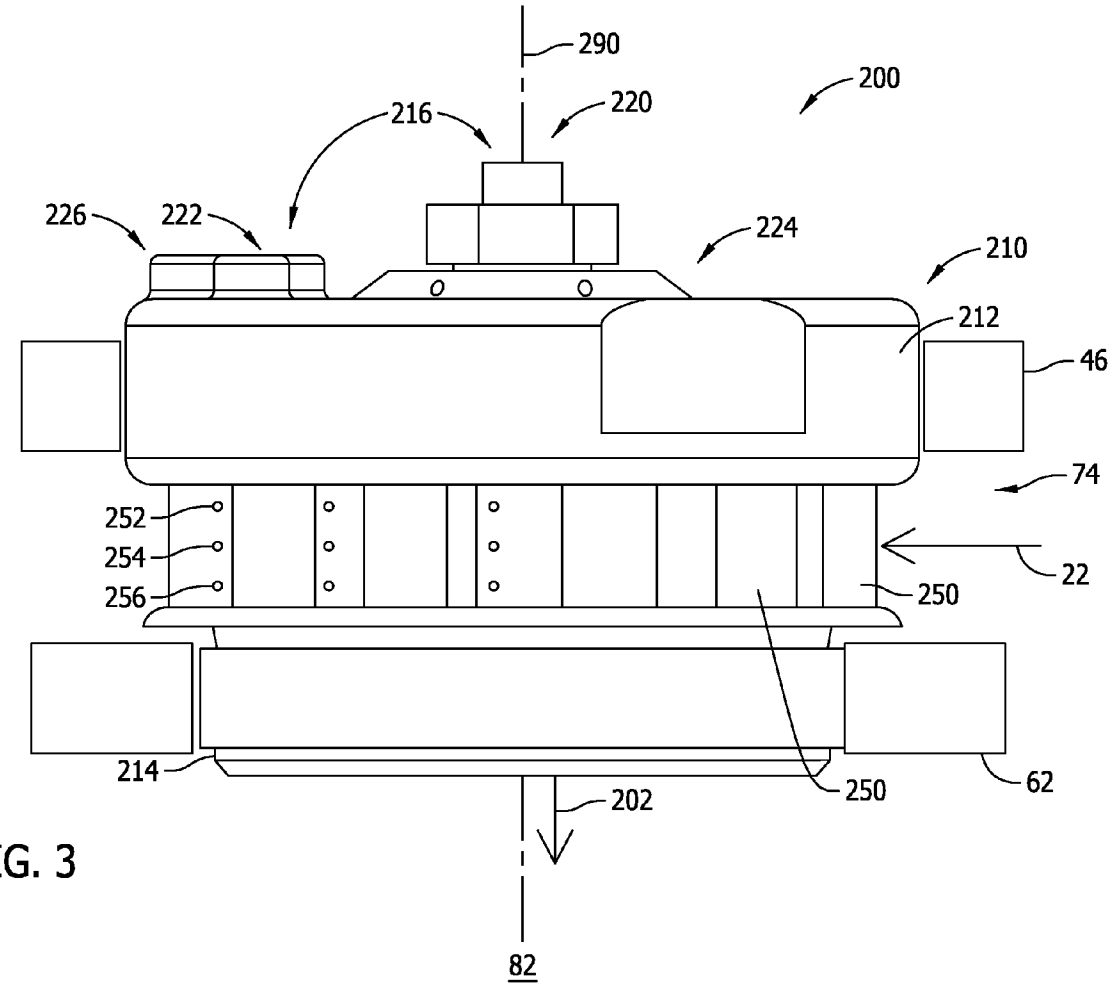
FIG. 3 is a perspective view of an exemplary fuel nozzle that may be used with the combustor assembly shown in FIG. 2.
Figure 4:
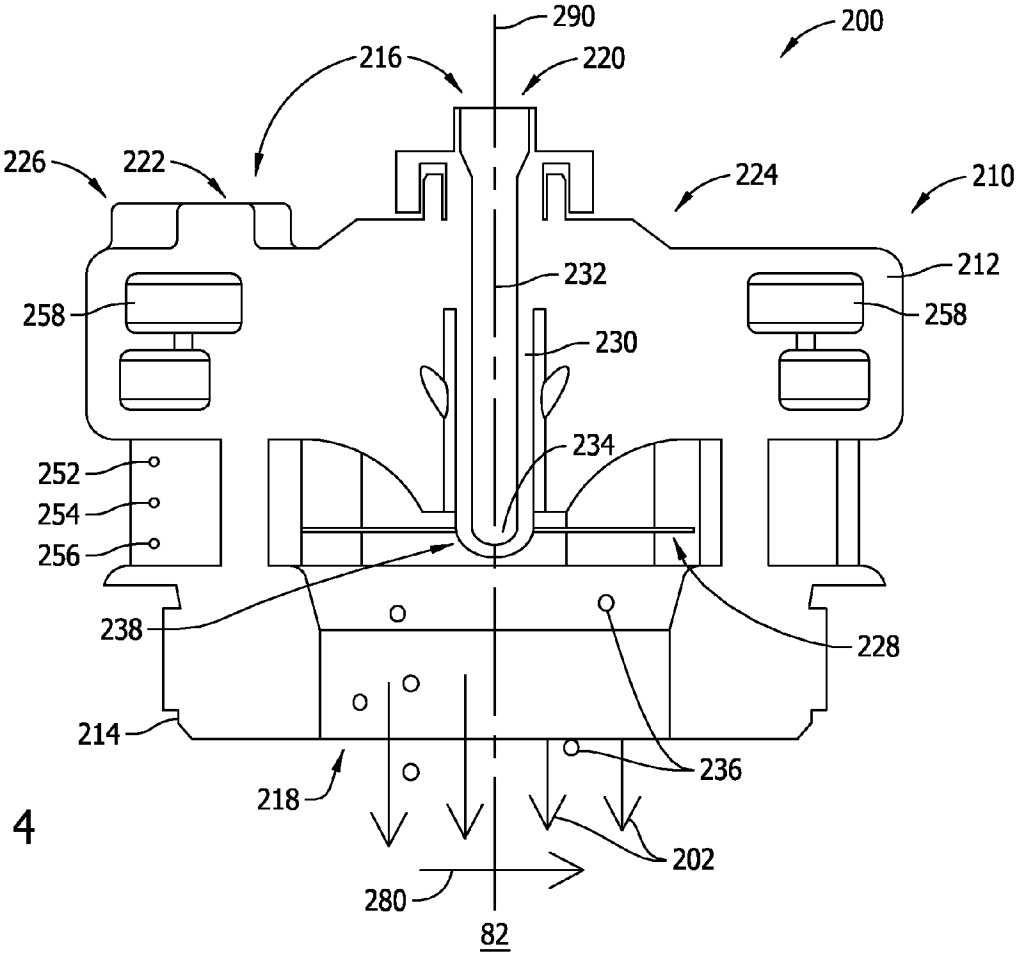
FIG. 4 is a cross-sectional view of the fuel nozzle shown in FIG. 3.

FIG. 3 is a perspective view of an exemplary fuel nozzle 200 that may be used with combustor 124 (shown in FIG. 2), and FIG. 4 is a cross-sectional view of fuel nozzle 200. In the exemplary embodiment, fuel nozzle 200 injects a fuel-air mixture 202 into combustion zone 82. More specifically, in the exemplary embodiment, fuel nozzle 200 injects fuel-air mixture 202 substantially radially into combustion zone 82 with respect to a combustor centerline 86 (shown in FIG. 2). Any suitable number of fuel nozzles 200 may be spaced circumferentially about combustion liner 62 that enables combustor 124 to function as described herein. Furthermore, in an alternative embodiment, fuel nozzle 200 may be positioned at any suitable axial location with respect to centerline 86 such that combustor 124 functions as described herein. For example, fuel nozzle 200 may be coupled between transition duct inner and outer walls 66 and 50 (shown in FIG. 2).

As described above, first air plenum 74 is between flow sleeve 46 and combustion liner 62, and is configured to receive compressed air 20 (shown in FIG. 2) from compressor section 114 (shown in FIG. 1). As such, in the exemplary embodiment, first air plenum 74 directs at least a portion of air 22 into fuel nozzle 200. Furthermore, air plenum 74 channels the remainder of air 22 not used in fuel nozzle 200 for use downstream from fuel nozzle 200. For example, air 22 may be used to cool liner 62 and/or may be used with other premixers (not shown) in combustor 124.

Although the structure of fuel nozzle 200 will be described in more detail below, it should be understood that the following description may also apply to a fuel nozzle 300 (not shown in FIGS. 3 and 4). In the exemplary embodiment, fuel nozzle 200 includes a nozzle body 210 that is substantially cylindrical and that includes a back plate 212, a front plate 214, and a mixing zone defined therebetween. When fuel nozzle 200 is inserted through flow sleeve 46, back plate 212 is coupled to flow sleeve 46, and front plate 214 is coupled to liner 62. A plurality of swirler vanes are positioned between back plate 212 and front plate 214 at a radially outer portion 226 of nozzle body 210. Furthermore, in the exemplary embodiment, swirler vanes 250 are spaced circumferentially about mixing zone 228 and about a centerline axis 290 of nozzle body 210.

In the exemplary embodiment, at least one inlet 216 is defined within back plate 212 and at least one discharge 218 is defined within front plate 214. In the exemplary embodiment, at least one inlet 216 includes a first inlet 220 and a second inlet 222 that are each defined within back plate 212. In the exemplary embodiment, first inlet 220 is defined within a radially center portion 224 of nozzle body 210 and second inlet 222 is defined within radially outer portion 226 of nozzle body 210. Although nozzle body 210 is substantially cylindrical in the exemplary embodiment, nozzle body 210 may have any other shape that enables nozzle 200 to function as described herein.

In the exemplary embodiment, nozzle body 210 includes a centerbody 230 that extends from back plate 212 along centerline axis 290. Centerbody 230 extends from back plate 212 and has any suitable length that enables at least a portion of centerbody 230 to extend into mixing zone 228 of fuel nozzle 200. In the exemplary embodiment, centerbody 230 has a substantially cylindrical shape. In alternative embodiments, centerbody 230 may have any suitable cross-sectional shape such as, but not limited to, a tapered cross-sectional shape. Centerbody 230 includes at least one outlet 234 defined therein that is coupled in flow communication with first inlet 220 via a fluid passage 232.

Centerbody 230 channels liquid fuel therethrough when in a first operational mode, and channels air therethrough when centerbody 230 is in a second operational mode. When centerbody 230 is in the first operational mode, outlet 234 discharges liquid fuel into mixing zone 228 for pre-mixing purposes. Furthermore, in the exemplary embodiment, outlet 234 facilitates airblasting, atomizing, or pre-vaporizing the liquid fuel into liquid fuel droplets 236 prior to combustion. When centerbody 230 is in the second operational mode, air is channeled therethrough to facilitate preventing fuel-air mixture 202 from re-circulating back into fuel nozzle 200 and to facilitate improving the flow structure of main flow 280 channeled through combustor 124.

As described above, when centerbody 230 is in the first operational mode, outlet 234 discharges liquid fuel into mixing zone 228. Accordingly, when centerbody 230 is in the first operational mode, a plurality of outlets 234 are defined within a centerbody tip 238 and are spaced about centerline axis 290. As such, the plurality of outlets 234 facilitate injecting liquid fuel into mixing zone 228 in a substantially radial direction. When centerbody 230 is in the second operational mode, outlet 234 is within centerbody tip 238 such that air is discharged into combustion zone 82 substantially coaxially with respect to centerline axis 290. As used herein, the term "axial", "axially", or "coaxially" refers to a direction along or substantially parallel to centerline axis 290 or combustor centerline 86. Furthermore, as used herein, the term "radial" or "radially" refers to a direction substantially perpendicular to centerline axis 290 or combustor centerline 86.

In the exemplary embodiment, each swirler vane 250 includes a fuel outlet defined therein. For example, swirler vane 250 includes a first gas fuel outlet 252, a second gas fuel outlet 254, and a third gas fuel outlet 256 defined therein. Gas fuel outlets 252, 254, and 256 are configured to inject fuel into mixing zone 228 for pre-mixing purposes. Although the exemplary embodiment includes three gas fuel outlets, fuel nozzle 200 may include any suitable number of gas fuel outlets such that fuel nozzle 200 functions as described herein.

In the exemplary embodiment, second inlet 222 is coupled in flow communication with gas fuel outlets 252, 254, and 256 via a gas fuel passage 258. More specifically, gas fuel passage 258 is defined within and extends circumferentially through back plate 212 with respect to centerline axis 290. As such, gas fuel passage 258 is coupled in flow communication with each fuel outlet 252, 254, and 256 of each swirler vane 250.

Figure 5:
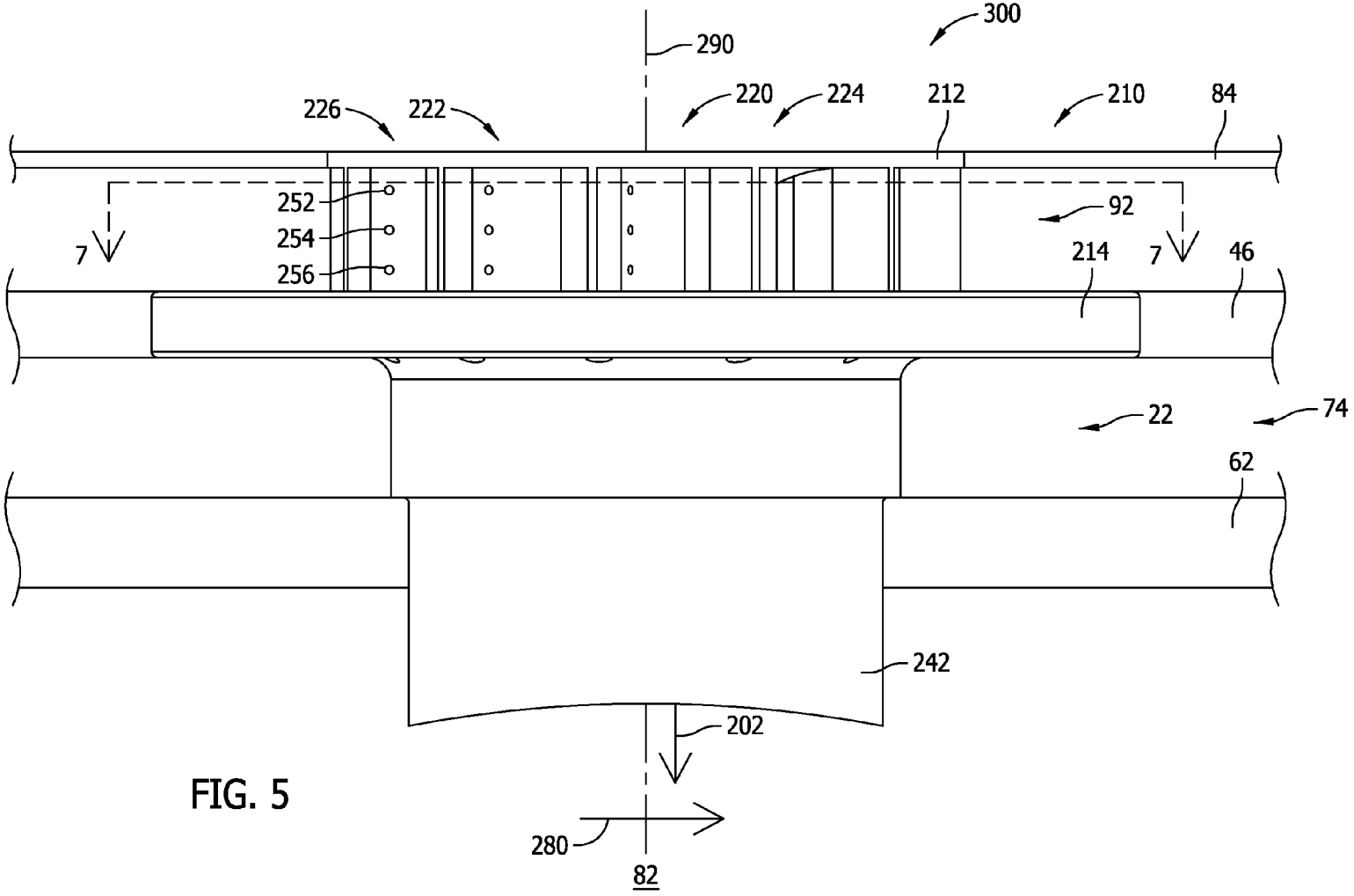
FIG. 5 is a perspective view of an exemplary fuel nozzle that may be used with the combustor assembly shown in FIG. 2.
Figure 6:
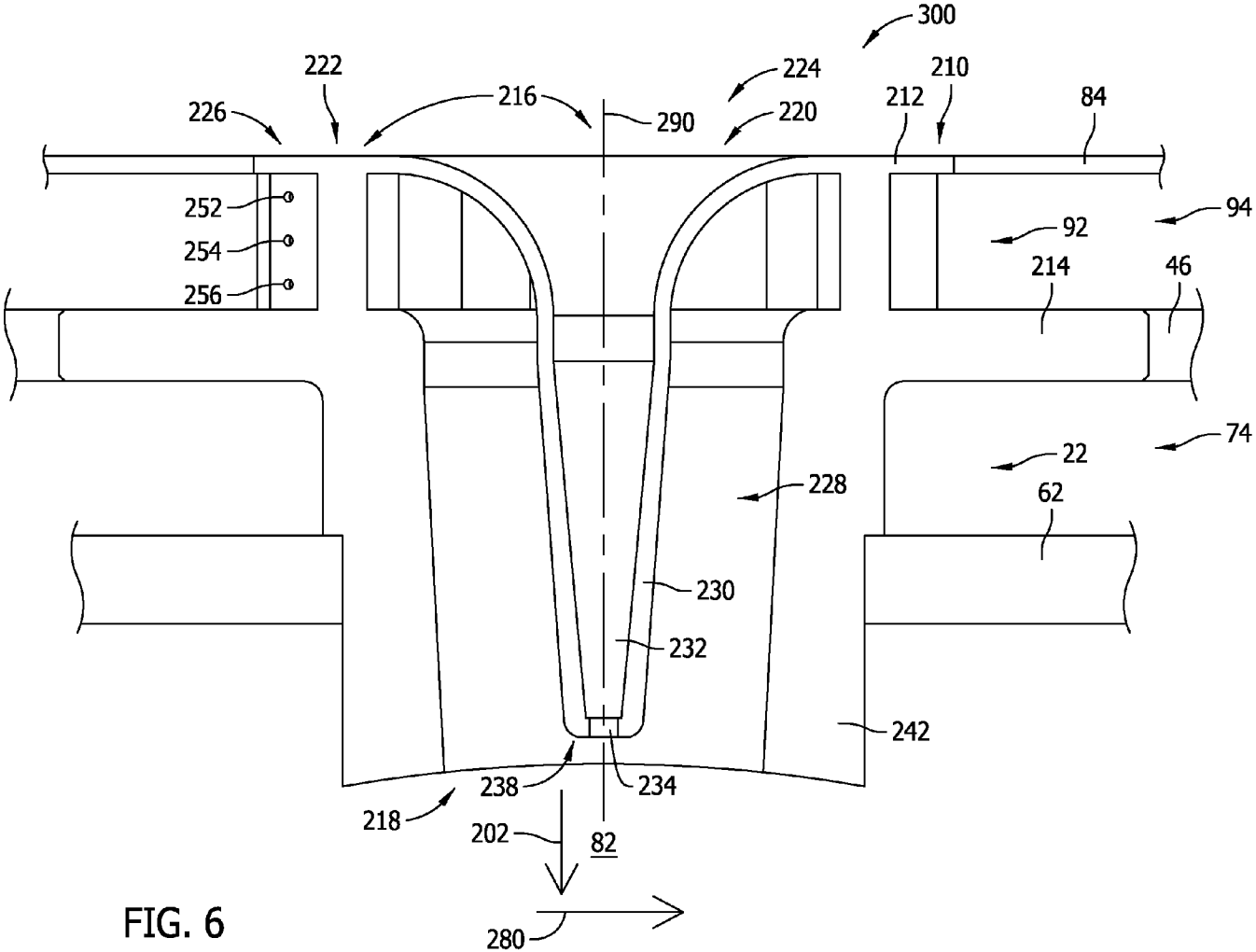
FIG. 6 is a cross-sectional view of the fuel nozzle shown in FIG. 5.

FIG. 5 is a perspective view of fuel nozzle 300 that may be used with combustor 124 (shown in FIG. 2), and FIG. 6 is a cross-sectional view of fuel nozzle 300. In the exemplary embodiment, fuel nozzle 300 injects fuel-air mixture 202 into combustion zone 82. More specifically, in the exemplary embodiment, fuel nozzle 300 injects fuel-air mixture 202 substantially radially into combustion zone 82 with respect to a combustor centerline 86 (shown in FIG. 2).

In the exemplary embodiment, fuel nozzle 300 includes back plate 212, front plate 214, and a nozzle portion 242 that extends from front plate 214. Accordingly, when fuel nozzle 300 is inserted through sheet 84, back plate 212 is coupled to sheet 84, front plate 214 is coupled to flow sleeve 46, and nozzle portion 242 is coupled to liner 62.

As mentioned above, first air plenum 74 is defined between flow sleeve 46 and combustion liner 62, and second air plenum 94 is defined between flow sleeve 46 and sheet 84. As such, in the exemplary embodiment, second air plenum 94 is configured to direct air 92 into fuel nozzle 300, and first air plenum 74 is configured to channel air 22 therethrough for use downstream from fuel nozzle 300. For example, air 22 may be used to cool liner 62 from the hot products that result from combustion and/or may be used with other pre-mixers (not shown) in combustor 124.

Figure 7:
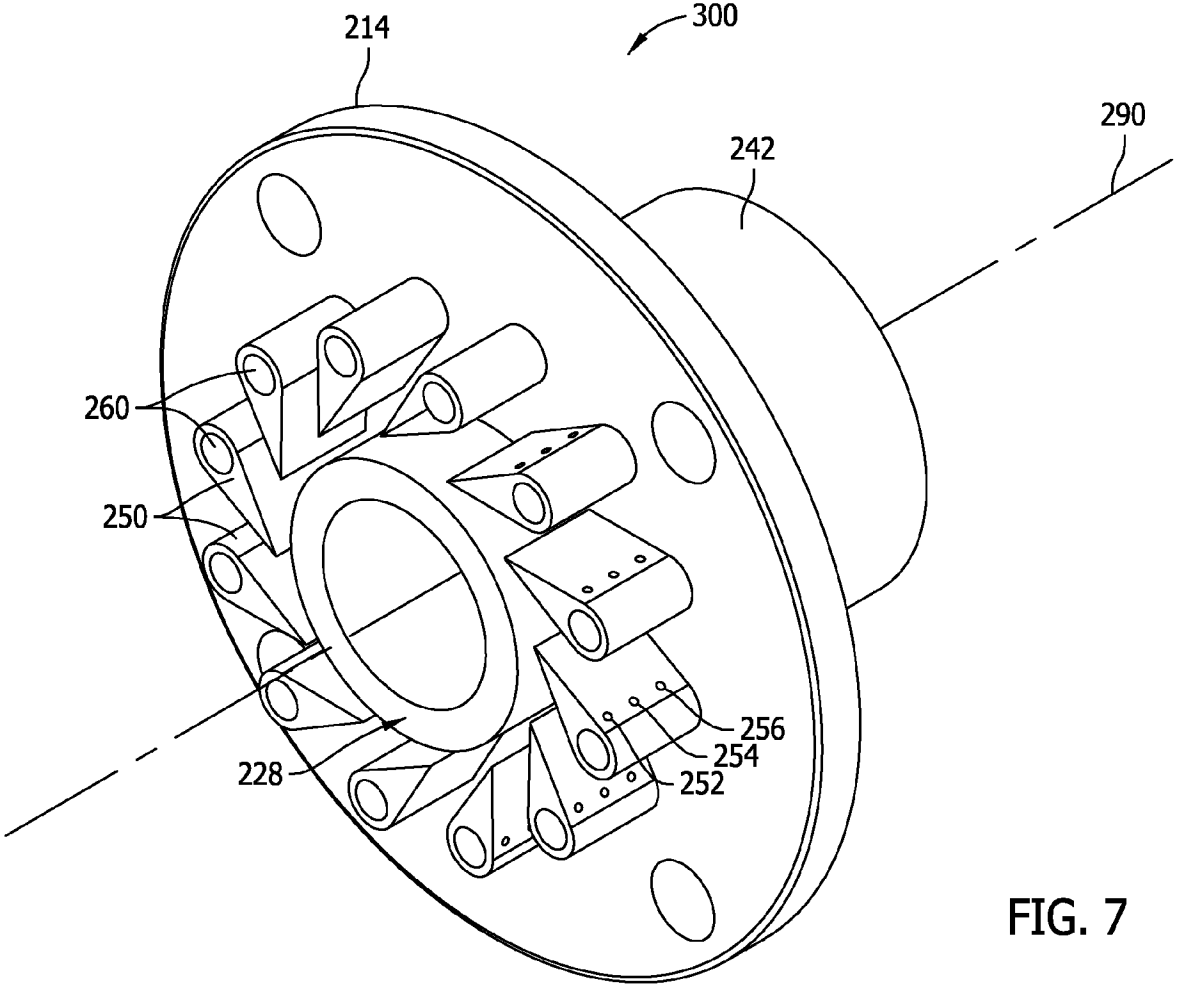
FIG. 7 is a perspective view of the fuel nozzle shown in FIG. 5 and taken along Line 7-7.
Figure 8:
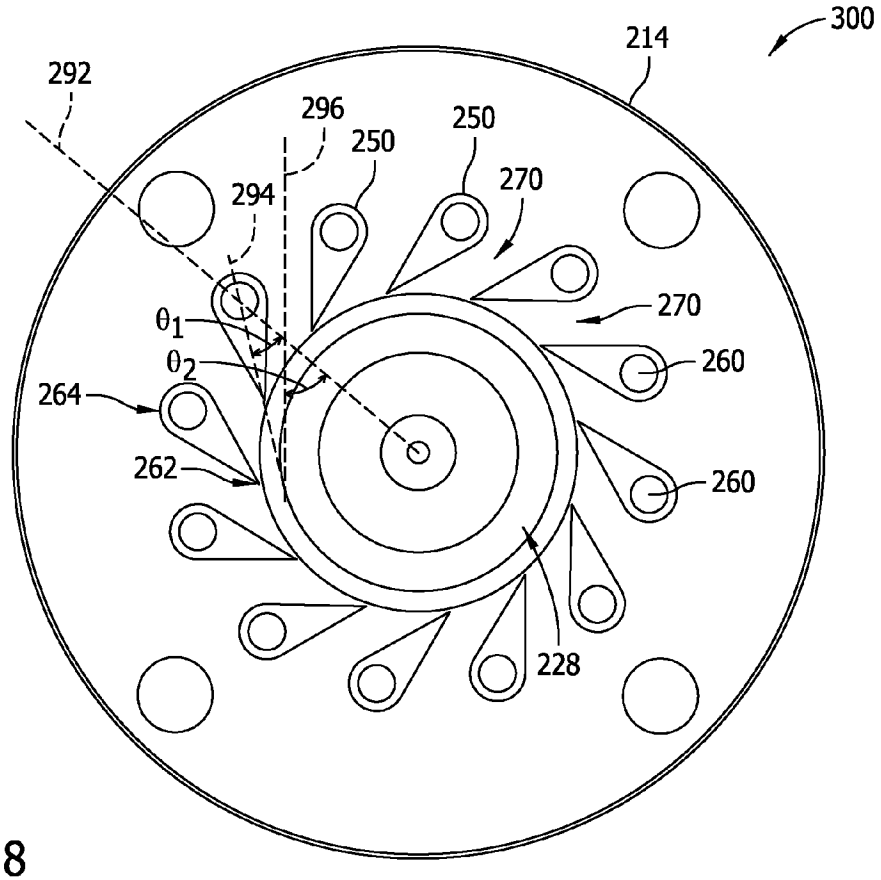
FIG. 8 is a top view of the fuel nozzle shown in FIG. 7.

FIG. 7 is a perspective cross-sectional view of fuel nozzle 300 taken along Line 7-7, and FIG. 8 is a top view of fuel nozzle 300 shown in FIG. 7. In the exemplary embodiment, each swirler vane 250 is spaced circumferentially about mixing zone 228 and about centerline axis 290 such that air 22 or 92 (shown in FIGS. 3-6) is directed obliquely into mixing zone 228 with respect to a radial centerline 292 of nozzle body 210. More specifically, in the exemplary embodiment, each swirler vane 250 has a centerline 294 that is oriented obliquely with respect to radial centerline 292 at an angle $\theta_1$ of from about 15° to about 60°. When swirler vanes 250 are spaced about centerline axis 290, air flow passages 270 are formed between adjacent swirler vanes 250. Accordingly, each air flow passage has a centerline 296 that is oriented obliquely with respect to radial centerline 292 at an angle $\theta_2$ of from about 15° to about 60°.

Accordingly, swirler vanes 250 are configured to facilitate swirling air and fuel within mixing zone 228. More specifically, when each swirler vane 250 is angled away from radial centerline 292, the air channeled through air flow passages 270 is facilitated to be swirled about centerline axis 290 within mixing zone 228. As such, the orientation of swirler vanes 250 facilitates forming a substantially uniform fuel-air mixture 202 in mixing zone 228 that is directed through discharge 218 for use in combustion zone 82.

In the exemplary embodiment, swirler vanes 250 include a tear-drop cross-sectional shape. However, swirler vanes 250 may have any other shape for directing air 22 or 92 into mixing zone 228 obliquely with respect to radial centerline 292. In the exemplary embodiment, swirler vanes 250 include a radially inner first end 262 and a radially outer second end 264 and gas fuel outlets 252, 254, and 256 are defined within swirler vane second end 264. As such, gas fuel discharged from gas fuel outlets 252, 254, and 256 is directed into mixing zone 228 by air 22 or 92 and channeled through air flow passages 270. Furthermore, in the exemplary embodiment, swirler vanes 250 each include a swirler vane passage 260 that facilitates flow communication between gas fuel outlets 252, 254, and 256 and second inlet 222 via gas fuel passage 258 (shown in FIG. 4).

Figure 9:
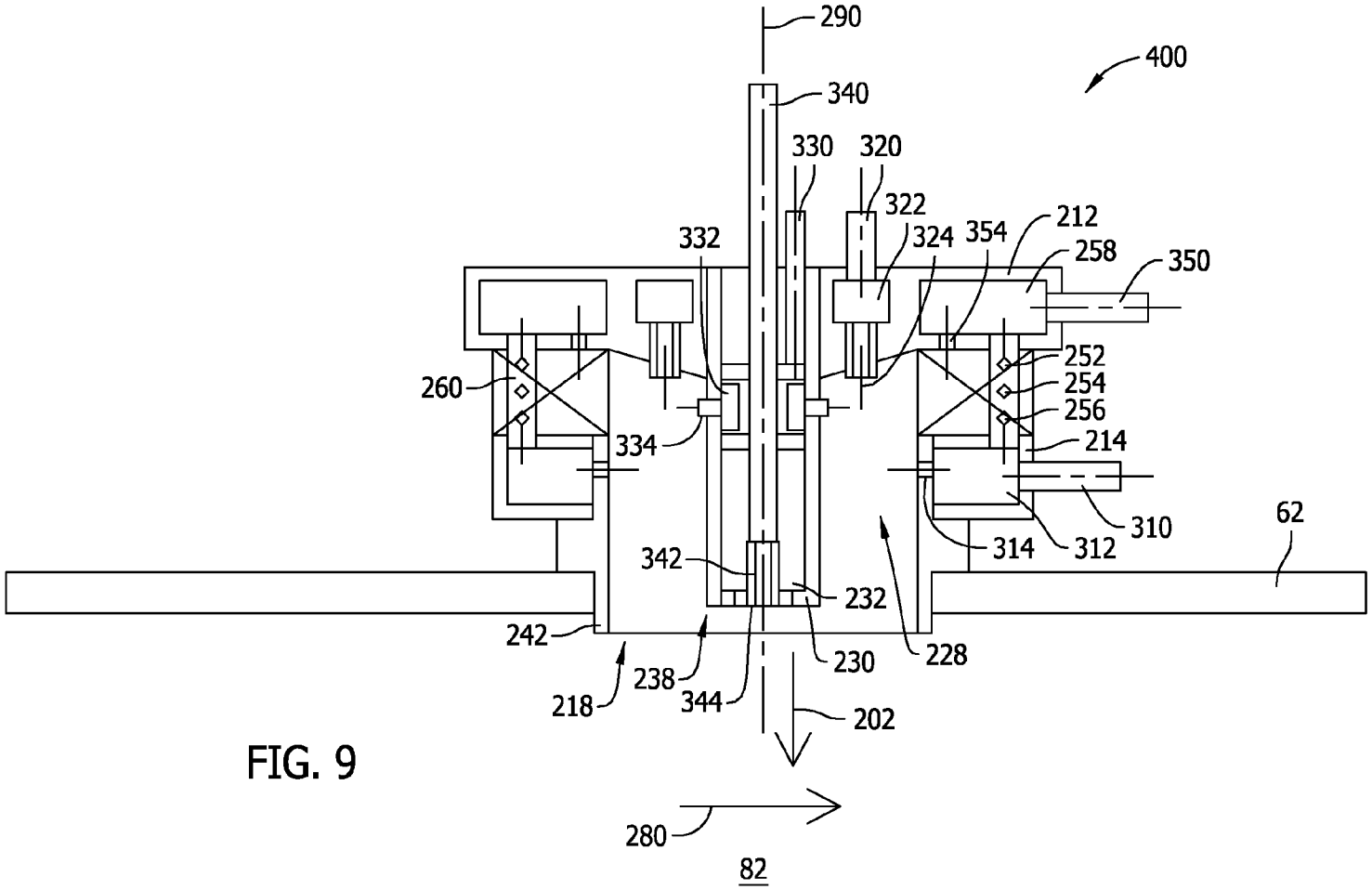
FIG. 9 is a cross-sectional view of an exemplary fuel nozzle that may be used with the combustor assembly shown in FIG. 2.

FIG. 9 is a cross-sectional view of a fuel nozzle 400 that may be used with combustor 124 (shown in FIG. 2). In the exemplary embodiment, fuel nozzle 400 includes fuel tubes 310, 320, 330, 340, and 350, fuel passages 312, 322, 332, 342, and 258, and fuel outlets 314, 324, 334, 344, and 354. Fuel outlets 314, 324, 334, 344, and 354 are defined within fuel nozzle 400 at any suitable location such that a substantially uniform fuel-air mixture 202 may be formed. More specifically, in the exemplary embodiment, fuel tube 310 extends substantially radially through front plate 214 and is coupled in flow communication with fuel passage 312. Fuel passage 312 is configured to supply fuel to fuel outlet 314 and/or gas fuel outlets 252, 254, and 256 for pre-mixing purposes. Fuel tube 320 extends substantially axially through back plate 212 and is coupled in flow communication with fuel passage 322. Fuel passage 322 is configured to supply fuel to fuel outlet 324 for pre-mixing purposes. Fuel tube 330 extends substantially axially within fluid passage 232 of centerbody 230 and is coupled in flow communication with fuel passage 332. Fuel passage 332 is configured to supply fuel to fuel outlet 334 for pre-mixing purposes. Fuel tube 340 extends substantially axially within fluid passage 232 from back plate 212 to nozzle tip 238 and is coupled in flow communication with fuel passage 342. Fuel passage 342 is configured to supply fuel to outlet 344 for fuel injection directly into combustion zone 82. Fuel tube 350 extends substantially radially through back plate 212 and is coupled in flow communication with fuel passage 258. Fuel passage 258 is configured to supply fuel to fuel outlet 354 and/or gas fuel outlets 252, 254, and 256 for pre-mixing purposes.

Similar to fuel passage 258 as described above, fuel passages 312, 322, 332, and 342 each extend circumferentially through fuel nozzle 400 with respect to centerline axis 290. Accordingly, any suitable number of fuel outlets 314, 324, 334, 344, and 354 may be coupled in flow communication with fuel passages 312, 322, 332, 342, and 258 such that fuel nozzle 400 functions as described herein. Furthermore, in one embodiment, fuel outlets 314, 324, 334, 344, and 354 are substantially equally spaced about centerline axis 290 such that a substantially uniform fuel-air mixture 202 is formed. In some embodiments, fuel outlets 314, 324, 334, 344, and 354 are not substantially equally spaced about centerline axis 290.

During operation, fuel nozzles 200, 300, and 400 may use gas fuel, liquid fuel, or a combination thereof for combustion purposes. In the exemplary embodiment, fuel nozzles 200, 300, and 400 use only gas fuel or only liquid fuel at a time, i.e. a dual fuel embodiment. In an alternative embodiment, fuel nozzles 200, 300, and 400 or may use both gas fuel and liquid fuel simultaneously during operation, i.e. a dual fire embodiment.

As such, in one embodiment, gas fuel enters gas fuel passage 258 through second inlet 222 (shown in FIG. 4) or through fuel tube 350. Gas fuel substantially fills gas fuel passage 258 such that gas fuel may be directed through each swirler vane passage 260. Swirler vane passage 260 is coupled in flow communication with gas fuel outlets 252, 254, and 256 such that gas fuel is discharged through gas fuel outlets 252, 254, and 256. As such, air 22 or 92 that is channeled through air flow passages 270 (shown in FIG. 8) mixes with gas fuel discharged from gas fuel outlets 252, 254, and 256 prior to entering mixing zone 228.

Furthermore, in one embodiment when centerbody 230 is in the first operational mode, liquid fuel enters inlet 220 (shown in FIG. 4) and is channeled through fluid passage 232. Liquid fuel is then discharged from outlet 234 (shown in FIG. 4) and mixed with air 22 or 92 in mixing zone 228. After a period of pre-mixing, air-fuel mixture 202 enters combustion zone 82 through discharge 218. As such, air-fuel mixture 202 mixes with main flow 280 and is ignited within combustion zone 82.

The fuel nozzle described herein facilitates reducing NOx emissions of a turbine engine by pre-mixing a portion of air and fuel such that combustion gas temperature is controlled. Moreover, the nozzle includes a plurality of swirler vanes that are spaced circumferentially about a mixing zone of the fuel nozzle. Each swirler vane is angled away from the radial centerline of the fuel nozzle such that air entering the fuel nozzle from the combustor air flow passage swirls within the mixing zone. As such, a substantially uniform air-fuel mixture is formed in the mixing zone prior to injection into the combustion zone thereby facilitating preventing combustion gas temperatures to exceed the threshold wherein NOx emissions are formed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of assembling a gas turbine assembly, said method comprising:

positioning a flow sleeve about a liner of a combustor, such that the flow sleeve extends circumferentially about the liner and defines a generally annular first plenum therebetween, wherein the liner at least partially defines a combustion zone of the combustor and extends circumferentially about a centerline of the combustor;

coupling a fuel nozzle to the combustor such that the fuel nozzle extends radially from at least the flow sleeve through the liner, wherein the fuel nozzle includes:

a nozzle body that includes a back plate, a front plate, and a mixing zone defined therebetween, wherein the back plate includes at least one inlet defined therein and the front plate includes at least one discharge defined therein;

a plurality of swirler vanes between the front plate and the back plate and circumferentially about the mixing zone such that the plurality of swirler vanes direct air obliquely into the mixing zone; and at least one outlet within at least one of the nozzle body and the plurality of swirler vanes, wherein the at least one outlet is configured to inject fuel into the mixing zone, wherein the back plate is directly coupled to the flow sleeve and the front plate is directly coupled to the liner such that a fuel-air mixture discharged from the fuel nozzle is directed generally radially towards the combustion zone relative to the centerline.

2. The method in accordance with claim 1 further comprising positioning the plurality of swirler vanes about the mixing zone such that a plurality of air flow passages are defined between adjacent swirler vanes, wherein each of the plurality of air flow passages are oriented obliquely with respect to a radial centerline of the nozzle body.

3. The method in accordance with claim 1 further comprising defining a gas fuel passage within at least one of the plurality of swirler vanes, wherein the gas fuel passage facilitates flow communication between the at least one inlet and the at least one outlet.

4. The method in accordance with claim 1 further comprising defining the at least one fuel outlet within a radially outer end of at least one of the plurality of swirler vanes.

5. The method in accordance with claim 1, wherein the nozzle body includes a centerbody, said method further comprising extending the centerbody from the back plate to at least partially within the mixing zone, wherein a fluid passage is defined within the centerbody, the fluid passage configured to facilitate flow communication between the at least one inlet and the at least one outlet.

6. A fuel nozzle for use with a combustor, said fuel nozzle comprising:

a nozzle body comprising:

a front plate configured to directly couple to a liner of the combustor, wherein the liner at least partially defines a combustion zone of the combustor and extends circumferentially about a centerline of the combustor;

a back plate spaced from said front plate such that said back plate is configured to directly couple to a flow sleeve of the combustor, wherein the flow sleeve extends circumferentially about the liner and defines a generally annular first plenum therebetween, and a mixing zone defined between said back plate and said front plate, said back plate comprising at least one inlet defined therein, said front plate comprising at least one discharge defined therein;

a plurality of swirler vanes positioned between said back plate and said front plate and spaced circumferentially about said mixing zone, each of said plurality of swirler vanes oriented to direct air obliquely into said mixing zone; and at least one outlet defined within at least one of said nozzle body and said plurality of swirler vanes, said at least one outlet configured to inject fuel into said mixing zone, wherein said fuel nozzle is configured to extend radially from at least the flow sleeve through the liner.

7. The nozzle in accordance with claim 6, wherein said at least one inlet comprises a gas fuel inlet and a liquid fuel inlet.

8. The nozzle in accordance with claim 7, wherein said gas fuel inlet is coupled in flow communication with said at least one outlet, wherein said at least one outlet is defined within at least one of said plurality of swirler vanes.

9. The nozzle in accordance with claim 6, wherein said at least one outlet is defined within a radially outer end of at least one of said plurality of swirler vanes.

10. The nozzle in accordance with claim 6, wherein at least one of said plurality of swirler vanes comprises a gas fuel passage defined therein, wherein said gas fuel passage channels fuel from said at least one inlet to said at least one outlet.

11. The nozzle in accordance with claim 6, wherein said nozzle body further comprises a centerbody extending from said back plate, said centerbody comprising a fluid passage defined therein that is coupled in flow communication with said at least one outlet, wherein said fluid passage is configured to channel liquid fuel therethrough when said centerbody is in a first operational mode.

12. The nozzle in accordance with claim 11, wherein said fluid passage is configured to channel air therethrough when said centerbody is in a second operational mode.

13. The nozzle in accordance with claim 6, wherein each of said plurality of swirler vanes comprises a centerline that is oriented obliquely with respect to a radial centerline of said nozzle body at an angle of from about 15° to about 60°.

14. The nozzle in accordance with claim 6, wherein each of said plurality of swirler vanes comprises a tear drop cross-sectional shape.

15. The nozzle in accordance with claim 6, wherein said plurality of swirler vanes are spaced about a centerline axis of said nozzle body such that a plurality of air flow passages are defined between adjacent swirler vanes, wherein each of said plurality of air flow passages are oriented obliquely with respect to a radial centerline of said nozzle body at an angle of from about 15° to about 60°.

16. A gas turbine assembly comprising:

a combustor comprising:

a liner at least partially defining a combustion zone and extending circumferentially about a centerline of said combustor; and a flow sleeve that extends circumferentially about said liner and defines a generally annular first air plenum therebetween; and a fuel nozzle coupled to said combustor such that said fuel nozzle extends radially from at least said flow sleeve through said liner, said fuel nozzle comprising:

a nozzle body comprising a back plate, a front plate, and a mixing zone defined therebetween, said back plate comprising at least one inlet defined therein, said front plate comprising at least one discharge defined therein;

a plurality of swirler vanes positioned between said back plate and said front plate and spaced circumferentially about said mixing zone, each of said plurality of swirler vanes oriented to direct air obliquely into said mixing zone; and at least one outlet defined within at least one of said nozzle body and said plurality of swirler vanes, said at least one outlet configured to inject fuel into said mixing zone, wherein said back plate is directly coupled to said flow sleeve and said front plate is directly coupled to said liner such that a fuel-air mixture discharged from said fuel nozzle is directed generally radially relative to the centerline towards said combustion zone.

17. The assembly in accordance with claim 16, wherein said fuel nozzle is configured such that air channeled through said first air plenum is channeled into said mixing zone of said fuel nozzle.

18. The assembly in accordance with claim 16, wherein said combustor further comprises a sheet positioned about said flow sleeve such that a second air plenum is defined therebetween.

* * * * *